United States Patent [19]

Romanauskas

[11] Patent Number: 4,509,940

[45] Date of Patent: Apr. 9, 1985

[54] FIXED ANGLE PELLETING ROTOR CONFIGURED TO PROVIDE A MAXIMUM CLEARING RATE FACTOR

[75] Inventor: William A. Romanauskas, Southbury, Conn.

[73] Assignee: E. I. Du Pont de Nemours and Company, Wilmington, Del.

[21] Appl. No.: 512,950

[22] Filed: Jul. 13, 1983

Related U.S. Application Data

[63] Continuation of Ser. No. 262,631, May 11, 1981, abandoned.

[51] Int. Cl.[3] ..... B04B 7/08

[52] U.S. Cl. ..... 494/16; 494/20; 494/37; 494/85

[58] Field of Search ..... 494/16, 17, 20, 37, 494/85, 81; 209/148; 364/508, 468; 233/26, 1 R, 27, 28

[56] References Cited

U.S. PATENT DOCUMENTS 4,202,487 5/1980 Edwards ..... 494/1

*Primary Examiner*—Robert W. Jenkins

[57] ABSTRACT

A fixed angle pelleting rotor is physically configured such that the clearing rate factor $K_R$, functionally related to the volume V of each bottle carried by the rotor, the number N of bottles carried by the rotor, the minimum and maximum distance of each bottle from the central axis of the rotor and the rotor speed, is a maximum.

4 Claims, 4 Drawing Figures

FIXED ANGLE PELLETING ROTOR CONFIGURED TO PROVIDE A MAXIMUM CLEARING RATE FACTOR

This application is a continuation of application Ser. No. 262,631, filed May 11, 1981, now abandoned.

TECHNICAL FIELD

This invention relates to a pelleting rotor for a centrifuge and, in particular, to a fixed angle pelleting rotor physically configured such that the clearing rate factor $K_R$ of the rotor is a maximum.

BACKGROUND OF THE INVENTION

It is, at times, advantageous to physically separate the particulate matter in a sample from the supernatant in which it is suspended. To effect this purpose it is common practice to utilize a device known as a "pelleting" centrifuge. The rotating member of such a device is, accordingly, termed a "pelleting" rotor. Most pelleting rotors are fixed angle rotors, known as such for the provision of cavities about the periphery thereof which are inclined at a predetermined fixed angle with respect to the vertical central axis of the rotor. The fixed angle may be zero degrees, defining a so-called "vertical tube" or "vertical angle" rotor. A fixed angle rotor is to be contrasted with a swinging bucket rotor in which sample carriers, or buckets, are pivotally mounted to the rotor and swing outwardly from a vertical to a horizontal position as the speed of rotation increases.

Rotor speed also serves as a mode of classification of centrifuge rotors. Rotors operable at speeds below approximately twenty thousand revolutions per minute are classified as "superspeed" rotors, while rotors which can operate above approximately twenty thousand revolutions per minute are called "ultraspeed" rotors.

For some time ultraspeed rotor users have utilized as a measure of performance of the rotor a factor known as the "clearing factor" K. It is well known that the clearing factor K associated with swinging bucket rotors is defined by the relationship (with dimensional constants omitted):

$$K = \frac{\ln [R_{max}/R_{min}]}{w^2} \quad (1)$$

where, w is the angular velocity of a bucket about a reference axis CL, $R_{max}$ is the distance between the reference axis CL and the radially outermost boundary of the bucket therefrom, and $R_{min}$ is the distance between the reference axis CL and the radially innermost point at which the sample bucket is located. The clearing factor K serves as an indication of the time required to pellet particles of a sample using a given rotor. The lower the K factor the shorter is the time required for a particle to pellet. However, this factor is usually of little use to the users of other centrifuges, such as superspeed centrifuges, since such users are typically concerned with larger numbers of particles and greater sample volumes. For example, users of ultraspeed centrifuges often do not utilize all of the rotor compartments due to limited sample quantity, whereas superspeed centrifuge users often require multiple runs to process a sample. Thus, when an ultraspeed centrifuge user is confronted by the problem of processing in a given time what to him is a large sample of supernatant and suspended particles, such a user is likely to respond by choosing the ultraspeed centrifuge rotor having a low K factor. Conversely, however, a user of a superspeed centrifuge when confronted by the problem of processing in a particular time what to him is a large sample of supernatant and suspended particles, would likely ignore the K factor as being inapplicable and most likely select the largest volume rotor and simply assume that this sized rotor provides the shortest processing time.

However, such reasoning, straightforward as it may seem, tends to overlook several drawbacks which attend large volume superspeed rotors and which, in fact, may make the largest sized rotor not as efficient in processing large quantities of a sample in a given time. For example, a larger volume rotor would tend to exhibit a concommitantly large physical configuration, which would lead to increased windage factors, thus detracting from rotor speed and the centrifugal force generated.

Accordingly, it is believed advantageous to provide a rotor in which the pelleting capacity of the rotor is based on considerations other than mere physical size or K factor.

SUMMARY OF THE INVENTION

This invention rleates to a fixed angle rotor physically configured such that the "clearing rate" factor $K_R$, defined as the maximum rotor volume divided by the clearing factot, is maximized. The clearing rate factor $K_R$ may be more specifically defined (with dimensional constants omitted) as $$K_R = \frac{(V)\,(N)\,w^2}{\ln [R_{max}/R_{min}]}$$

where V is the volume of each bottle carried by the rotor, N is the number of bottles, w is the angular velocity, $R_{min}$ is the radially inner point of the sample in each bottle while $R_{max}$ is the radially outer point in each bottle, both as measured with respect to the central axis CL of the rotor. The volume of a sample able to be carried by the rotor is determined by the volume V of the sample in each bottle and the number N of bottles, the rotor speed w, and the pelleting distance parameters of a rotor are determined and selected in accordance with the instant invention in a manner such that the clearing rate factor $K_R$ of the rotor is maximized. The present invention may be used with any fixed angle (including vertical angle), pelleting rotor whether the rotor is to operate either in the superspeed or ultraspeed range.

BRIEF DESCRIPTION OF THE DRAWINGS

The invention will be more fully understood from the following detailed description thereof, taken in connection with the accompanying drawings, which form part of this application and in which.

DETAILED DESCRIPTION OF THE INVENTION

Figure 1:
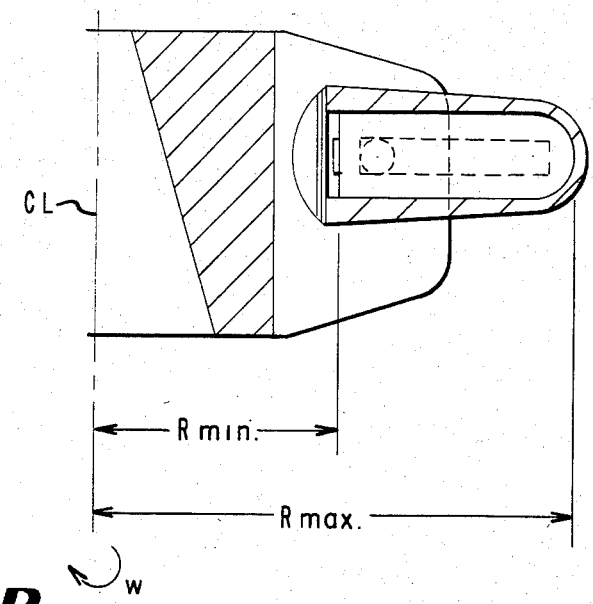
FIG. 1 is a stylized illustration of a portion of a swinging bucket rotor defining the various parameters upon which the clearing factor K is dependent.

Throughout the following description, similar reference characters refer to similar elements in all figures of the drawings.

It is well known that the clearing factor K associated with swinging bucket rotors is defined by the relationship (with dimensional constants omitted):

$$K = \frac{\ln [R_{max}/R_{min}]}{w^2} \quad (1)$$

where, (ln) is the logarithm to the base e, w is the angular velocity of a bucket about a reference axis CL, $R_{max}$ is the distance between the reference axis CL and the radially outermost boundary of the bucket therefrom, and $R_{min}$ is the distance between the reference axis CL and the radially innermost point at which the sample column in the bucket is located.

The parameters used in equation (1) are defined diagrammatically in FIG. 1.

The time required for a particle in a suspension to sediment, or be separated from, its supporting supernatant liquid medium, is defined by the relationship:

$$T = \frac{K}{S} \quad (2)$$

where

T is the sedimentation time,

K is the clearing factor, and

S is a constant for the paticular particulate suspension known as the sedimentation coefficient.

In connection, for example, with fixed angle superspeed centrifuge rotors commonly used for pelleting, or separating large volumes of particles from the supporting medium, it is commonly believed that the larger the physical size of the rotor, the greater the throughput of the rotor. However, by analogy to the swinging bucket case, it has been recognized that it is possible to define for any fixed angle rotor an indication of the volume of a sample from which the particulate matter may be separated in a given time. This indication may be referred to as the clearing rate factor, $K_R$, and may be thus defined as:

$$K_R = \frac{\text{Volume}}{T} \quad (3)$$

where

Volume is the volume of sample able to be carried by the rotor; and

T is the time.

From equation (2) it is known that $$K_R = \frac{\text{Volume } S}{K} \quad (3A)$$

Equation (1) then makes it clear that (with dimensional constants omitted)

$$K_R = \frac{(\text{Vol.})\, w^2}{\ln [R_{max}/R_{min}]} \quad (3B)$$

From the foregoing it may be appreciated that when the clearing rate factor $K_R$ for a particular rotor is maximized, that rotor will pellet the largest volume of sample in a particular time interval. Thus, for fixed angle rotors, the clearing rate factor $K_R$ serves as a useful comparison figure, akin to the clearing factor K for swinging bucket rotors, by which a determination of the relative efficiencies of rotors may be identified.

With reference to equation (3B), certain rotor parameters may be identified which have a bearing on the terms of that equation. For example, the motor torque imposed by the centrifuge drive motor directly affects the angular rotational velocity w of the rotor. Additionally, the windage, or resistance to rotor motion generated by a given rotor configuration has an impact on the rotational speed w. So too does the temperature of the air in the chamber in which the rotor is rotated, as in the case of refrigerated superspeed rotors.

Although physical size parameters of the rotor and of the chamber have an effect upon rotor speed w (as by modifying the windage), the impact of the physical size parameters of a rotor are directly felt in determining the volume of sample able to be carried by a rotor. Thus, the number and location of the cavities which receive sample bottles or tubes (referred to hereafter as "bottles"), the length, diameter and volume of the bottles, as well as the angle the axis of the bottle-receiving cavity defines with the vertical centerline of the rotor, impact upon the sample volume and logarithmic terms of equation (3B).

Figure 2B:
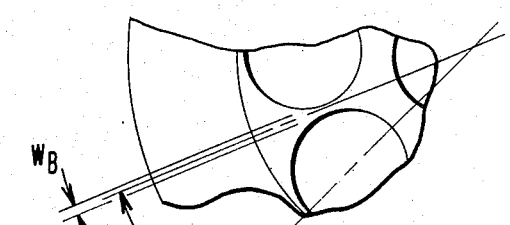
FIGS. 2A and 2B are graphic definitional diagrams illustrating various physical parameters of a fixed angle rotor which impact upon the clearing rate factor $K_R$.
Figure 2A:
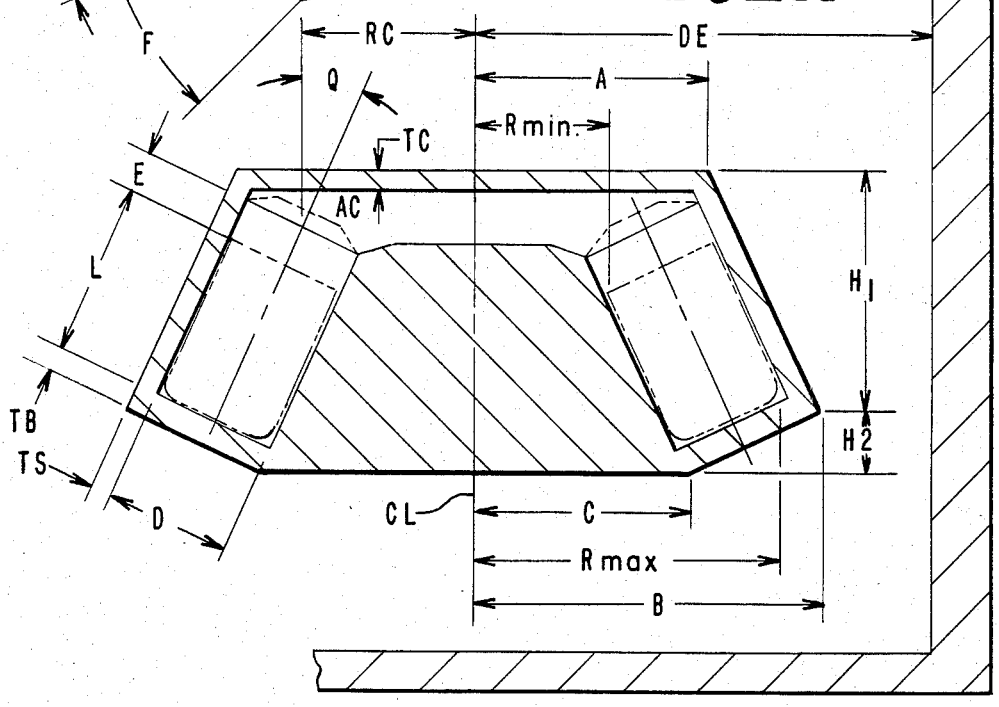

With reference to FIG. 2A shown is a definitional diagram illustrating various of the physical parameters in the general case of a fixed angle rotor. The rotor is shown as disposed within a chamber defined by an evaporator, the central axis CL of the rotor being spaced a radial distance DE from the boundary wall of the evaporator. The rotor is mountable on a shaft (not shown) driven by a motor (also not shown) about the central axis CL. If desired, the rotor may exhibit inclined sides with the distance from the flat top of the rotor to the junction of the inclined sides being indicated by the reference character H1. The vertical distance from the junction to the flat base of the rotor is indicated by the reference character H2. The radial dimension of the top of the rotor is defined by the character A while the radial dimension of the base of the rotor is defined by the character C. The junction of the sides lies a distance B from the central axis CL. The top of the rotor has a thickness TC.

The rotor includes a plurality of cavities each of which exhibits a predetermined length L and diameter D. The cavities are adapted to receive a bottle having a cap thereon, the height dimension of the cap being indicated by the character E. Each bottle is adapted to hold a volume V of liquid having particles to be pelleted suspended therein. The thickness of the sidewall and base of each cavity is indicated by the characters TS and TB, respectively. There are n cavities angularly disposed about the periphery of the rotor, so that from N number of bottles (where N lies from 1 to n) may be inserted into the rotor. The closest point at which the sample lies to the central axis CL is defined as the distance $R_{min}$, while the outermost radial distance from the central axis CL is designated as the distance $R_{max}$. The distances $R_{max}$ and $R_{min}$ are a function of the angle Q which the axis AC of each cavity makes with the central axis CL. The radial distance between the center of the cap of each bottle and the central axis CL is defined by the character RC. As seen in FIG. 2B, the axes of adjacent cavities are angularly spaced a distance 2F from each other, where F is the angular distance between a radius passing through the central axis CL and intersecting the axis of the cavity RC and the angular midpoint of the web $W_B$ between adjacent cavities. As may be appreciated, the distance A is a function of the number n of cavities, while the web thickness $W_B$ is related to the material selected for use in the rotor. Of course, the above parameters will be appropriately modified in the cases of a vertical angle rotor and/or a nonrefrigerated rotor.

Having defined these parameters, it may be seen that equation (3B) may be expressed, in terms of FIGS. 2A and 2B, as follows (with dimensional constants omitted):

$$K_R = \frac{(V)\,(N)\,w^2}{\ln\,[R_{max}/R_{min}]} \qquad (4)$$

where V, N, w, $R_{max}$ and $R_{min}$ are defined as set forth in the preceding paragraphs.

Once the relationship for $K_R$ is defined, it is necessary to determine the physical parameters of the rotor (as defined in FIGS. 2A and 2B) which will maximize $K_R$. The quantity $w^2$, the angular velocity of the rotor, may itself be defined as a function of the physical parameters of the rotor, including the volume V of sample in each bottle, the number of bottles N, $R_{max}$ and $R_{min}$. The definition of $w^2$ in these terms may be generated by recognizing that the windage loss of the rotor is a function of the physical parameters of the rotor. The maximum available rotor torque is limited by the torque generated by the centrifuge motor and is a function of angular velocity. Motor torque as a function of angular velocity is derivable empirically. From these bases, the definition of $w^2$ as a function of the physical parameters of the rotor may be generated.

Once $w^2$ is expressed as a function of the physical parameters of rotor, $K_R$ may be expressed totally in those terms. Then, selecting a given sample volume V, it is possible to mathematically or empirically verify the values of $K_R$ obtained when the physical parameters of the rotor are varied. The results of a mathematical analysis of the values of $K_R$ produced when the physical parameters of the rotor are varied using bottles having predetermined volumes is plotted as a function of the number N of bottles in FIG. 3 (assuming each bottle to be filled with sample to be separated). Partially filled bottles can have $K_R$ factors even higher than those shown in FIG. 3 for full bottles. Each point on each plot shown in FIG. 3 is derived from a particular set of values for the physical parameters of a rotor which is sized to accommodate a predetermined number N of bottles having a predetermined volume capacity.

Figure 3:
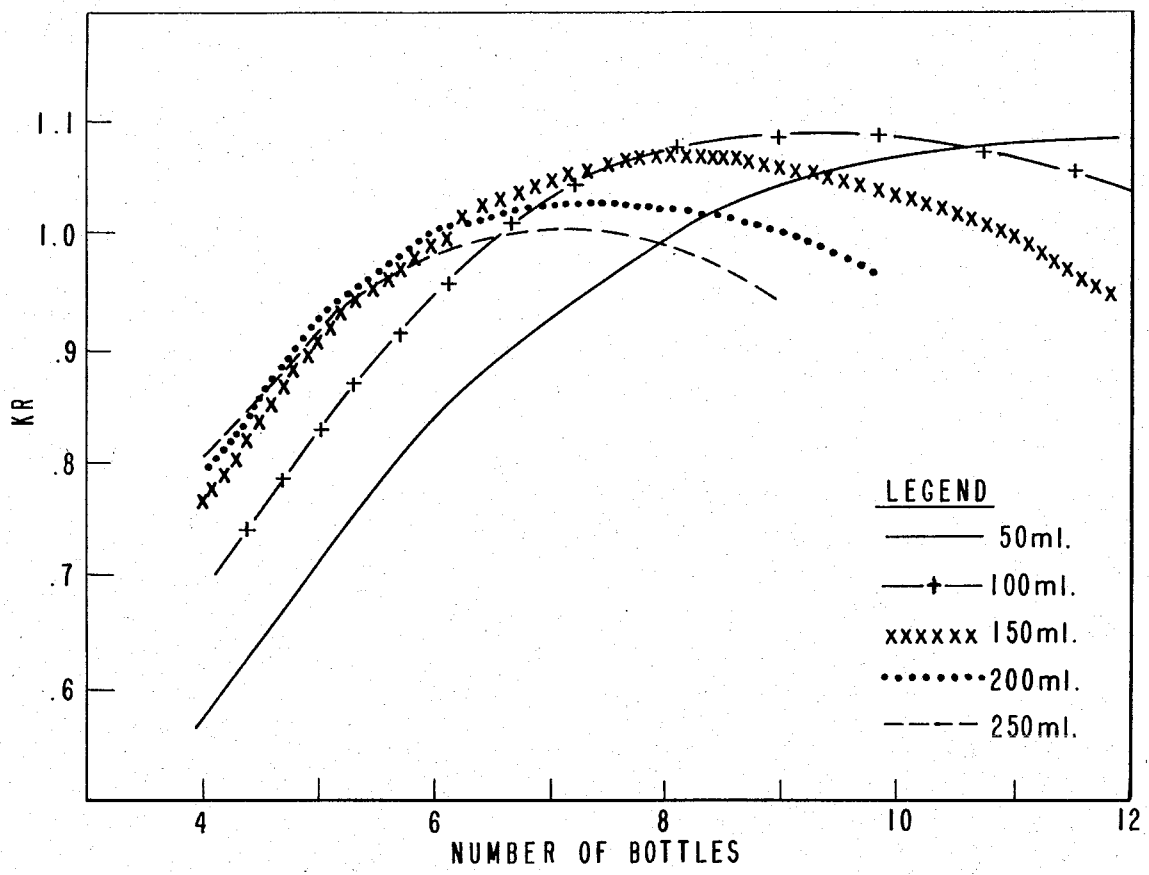
FIG. 3 is a graphical illustration showing clearing rate factor $K_R$ as a function of the number of bottles and bottle volume.

As seen from FIG. 3, if it is desired to use, for example, bottles having a capacity of 100 ml, the $K_R$ values generated when the various physical parameters are varied are plotted. The values of $K_R$ so generated may be conveniently calculated using a digital computer. In FIG. 3, it may be noted that the physical parameters of the rotor when the rotor is sized to accommodate ten bottles results in the highest $K_R$ value (approximately 1.1) for that rotor. Similarly, if it is desired to utilize 50 ml bottles, the physical parameters of the rotor are varied and $K_R$ therefor are determined. A rotor having physical parameters sized to accommodate twelve bottles results in the highest $K_R$ value (approximately 1.08) for that rotor. As a still further example, for a rotor utilizing 150 ml bottles, the physical parameters of a rotor sized to accommodate eight bottles results in the highest $K_R$ value (approximately 1.07) for that rotor. Similar examples for rotors utilizing 200 ml and 250 ml are also available from FIG. 3.

In view of the foregoing it may be appreciated that if a centrifuge rotor is arranged such that for a predetermined bottle size the physical parameters and number of bottles are selected such that the clearing rate factor $K_R$ value associated therewith is maximized, the largest throughput of material for that rotor will be provided. It is again noted and should be appreciated that although portions of the preceding description may have focussed or exemplified fixed angle superspeed centrifuge rotors, the present invention may be used with any fixed angle (including vertical angle) rotor, whether that rotor is to operate in either the superspeed or ultraspeed range.

Those skilled in the art, having the benefit of the foregoing teachings, may effect numerous modifications thereto. Such modifications are to be construed as lying within the scope of the instant invention, as defined in the appended claims.

What is claimed is:

1. A rotor member rotatable about its central axis CL at an angular speed w, the rotor having n cavities each able to receive a bottle such that a number of bottles N, where N is from 1 to n, are insertable into the rotor, each bottle being able to receive a predetermined volume V of suspension of particles to be pelleted, the particles being responsive to a centrifugal force field to move from a radially inner point in each bottle disposed at a distance $R_{min}$ from the axis CL to a radially outer point in each bottle disposed a distance $R_{max}$ from the axis CL, the rotor member having a clearing rate factor $K_R$ associated therewith, the values of w, V, N, $R_{min}$ and $R_{max}$ being determined such that the clearing rate factor $K_R$ defined by the relationship $$K_R = \frac{(V)\,(N)\,w^2}{\ln\,[R_{max}/R_{min}]}$$

is a maximum.

2. The rotor of claim 1 wherein the angular speed w of the rotor is less than approximately twenty thousand revolutions per minute.

3. The rotor of claim 1 wherein the angular speed w of the rotor is greater than approximately twenty thousand revolutions per minute.

4. A method for producing a centrifuge rotor rotatable about its central axis CL at an angular speed w, the rotor having n cavities with each cavity able to receive a bottle such that a number of bottles N, where N is from 1 to n, are insertable into the member, each bottle being able to receive a predetermined volume V of suspension of particles to be pelleted, the particles being responsive to a centrifugal force field to move from a radially inner point in each bottle disposed at a distance $R_{min}$ from the axis CL to a radially outer point in each bottle disposed at a distance $R_{max}$ from the axis CL, comprising the steps of:

(a) determining the physical size parameters of the rotor such that a clearing rate factor $K_R$ associated therewith defined by the relationship $$K_R = \frac{(V)\,(N)\,w^2}{\ln\,[R_{max}/R_{min}]}$$

is a maximum; and (b) providing a rotor in accordance with the determination of said physical size parameters such that the clearing rate factor $K_R$ of the rotor is a maximum.

* * * * *